US007476130B2

(12) United States Patent
Wakita et al.

(10) Patent No.: US 7,476,130 B2
(45) Date of Patent: Jan. 13, 2009

(54) CONNECTION STRUCTURE FOR RESISTIVE ELEMENT

(75) Inventors: Hidekazu Wakita, Tokyo (JP); Toshiaki Yokoyama, Tokyo (JP)

(73) Assignee: Niles Co., Ltd., Tokyo (JP)

( * ) Notice: Subject to any disclaimer, the term of this patent is extended or adjusted under 35 U.S.C. 154(b) by 0 days.

(21) Appl. No.: 11/663,527

(22) PCT Filed: Sep. 21, 2005

(86) PCT No.: PCT/JP2005/017418

§ 371 (c)(1),
(2), (4) Date: Apr. 12, 2007

(87) PCT Pub. No.: WO2006/033366

PCT Pub. Date: Mar. 30, 2006

(65) Prior Publication Data

US 2007/0264884 A1 Nov. 15, 2007

(30) Foreign Application Priority Data

Sep. 22, 2004 (JP) ..... 2004-275534

(51) Int. Cl.
*H01R 13/68* (2006.01)

(52) U.S. Cl. ..... 439/620.34; 439/698

(58) Field of Classification Search ..... 439/68, 439/73, 620.34, 620.24, 698
See application file for complete search history.

(56) References Cited

U.S. PATENT DOCUMENTS 3,820,054 A * 6/1974 Clewes et al. ..... 439/73

FOREIGN PATENT DOCUMENTS

JP 10-014061 1/1998
JP 2002-313191 10/2002

* cited by examiner

*Primary Examiner*—Javaid Nasri
(74) *Attorney, Agent, or Firm*—Jordan and Hamburg LLP

(57) ABSTRACT

Staking and soldering are eliminated to improve workability in assembly. A connection structure for a resistive element, in which the resistive element having lead wires at both ends is connected to a connection section of a base. A cover is fixably mounted on the base. Further, fixation claws capable of snap-holding the resistive element by elastic force and elastic tongues along lead wires are arranged on the cover. When the cover is fixed to the base, the elastic tongues are in elastic contact with the connection section through the lead wires to press the lead wires to the connection section.

6 Claims, 4 Drawing Sheets

CONNECTION STRUCTURE FOR RESISTIVE ELEMENT

BACKGROUND OF THE INVENTION

The present invention relates to a connection structure to resistive element employed for a lever switch device of an automobile.

The aforementioned connection structure for resistive element as shown in FIGS. 10 and 11 has been known. FIG. 10 is a sectional view showing a portion of an operation lever of a lever switch including the connection structure for resistive element. FIG. 11 is a plan view supplementarily showing a base.

Referring to FIG. 10, the lever switch device with an operation lever 101 is provided for a combination switch installed in the steering column. The operation lever 101 includes a base 103, first, second and third levers 105, 107 and 109, and first and second rotary knobs 111 and 113. The operation lever 101 is operated to activate a turn signal switch and a headlight selector switch. Then the first rotary knob 111 is operated to drive the wiper washer switch, and the second rotary knob 113 is operated to drive the fog lamp switch.

A slide switch for executing a cruise control is provided at a top end (out of view from the left side of FIG. 10) of the operation lever 101. The base 103 is provided with a terminal 116 for transmitting an electric signal upon operation of the slide switch. The connection section 117 of the terminal 116 is provided with a resistive element 119 (see FIG. 11).

The resistive element 119 is attached to the connection section 117 through staking and soldering. That is, lead wires 121 at both ends of the resistive element 119 are calked and soldered to the connection sections 117. This makes it sure to connect the resistive element 119 to the terminal 116.

In the aforementioned connection structure, a large number of steps are required for attaching the resistive element 119, thus limiting to improve the workability in assembly. Patent Document 1: Japanese Unexamined Patent Application Publication No. 2002-313191.

SUMMARY OF THE INVENTION

The limit to improve the workability in assembly is intended to be solved.

The present invention is characterized in that a cover which may be fixed to the base is provided with a retaining portion capable of retaining the resistive element and an elastic portion along the lead wire. When the cover is fixed to the base, the elastic portion elastically pushes the lead wire against the connection section.

In the connection structure for resistive element, a cover allowed to be fixed to the base is provided, the cover includes a retaining portion capable of retaining the resistive element and an elastic portion along the lead wires, and the elastic portion serves to elastically push the lead wires against the connection section upon fixing of the cover to the base. The resistive element may be assembled to the base together with the cover. This may omit the staking and soldering as the process for connecting the lead wire to the connection section, thus improving the assembly workability.

In the case where the retaining portion is a fixing claw disposed adjacent to the elastic portion to snap fasten the resistive element with elastic force, and the elastic portion is provided by forming a slit in the cover, when the cover is fixed to the base while snap-holding the resistive element between the fixing claws, the elastic portion receives the abutment force from the connection section via the lead wire. The elastic portion is bent by the abutment force with respect to the cover to apply the elastic force to the lead wire. This makes it sure to perform the connection through pushing the lead wire against the connection section.

In the case where the elastic portion includes a protruding holding portion that protrudes toward the lead wire which abuts the protruding holding portion, the connection section includes a connection groove to which the lead wire is fit, and the protruding holding portion allows the lead wire to be pushed against the connection groove with the elastic force of the elastic portion, the connection groove serves as a wedge between the lead wire and the connection section so as to be connected.

In the case where the base is disposed in a lever switch of an automobile to relay an operation signal of a switch operation unit of the lever switch device, the workability of assembling the lever switch device may be improved.

BRIEF DESCRIPTION OF THE DRAWINGS

FIG. 3(*b*) is an enlarged view showing the connection between the connection section and the lead wires (the first embodiment);

DETAIL DESCRIPTION OF THE INVENTION

The improvement of the workability in assembly as the object has been realized by the cover with the elastic portion.

FIRST EMBODIMENT

Figure 1:
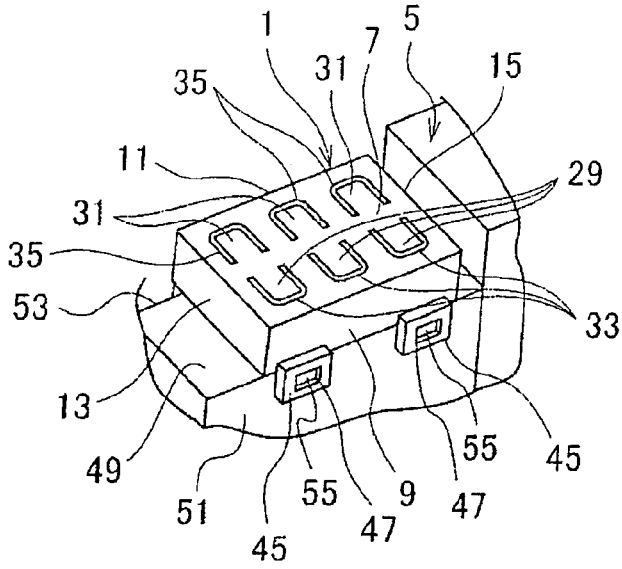
FIG. 1 is a perspective view showing an essential portion where the cover is attached to the base (a first embodiment)
Figure 2:
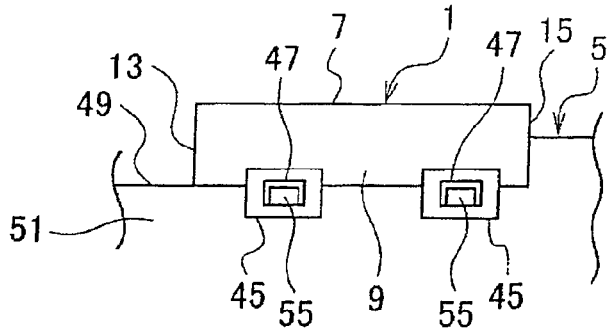
FIG. 2 is a side view showing an essential portion where the cover is attached to the base (the first embodiment)
Figure 3:
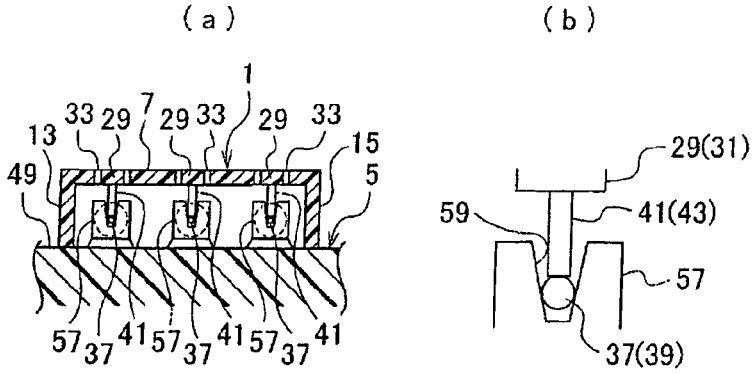
FIG. 3(*a*) is a sectional view showing an essential portion where the cover is attached to the base (the first embodiment)
Figure 4:
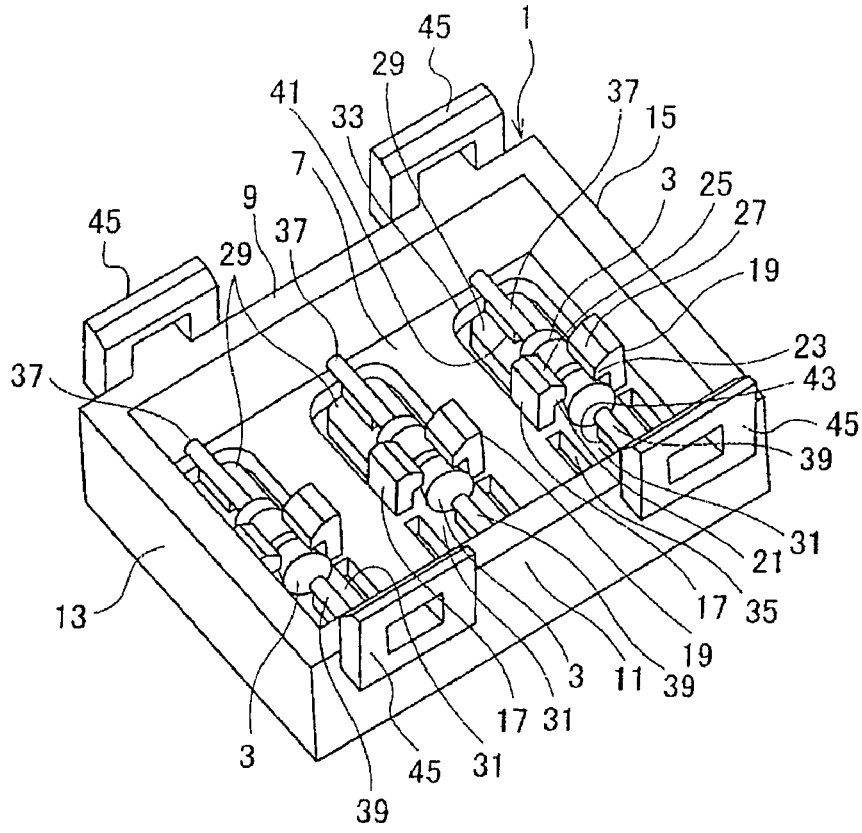
FIG. 4 is a perspective view showing the state where the resistive element is attached to the cover (the first embodiment)
Figure 5:
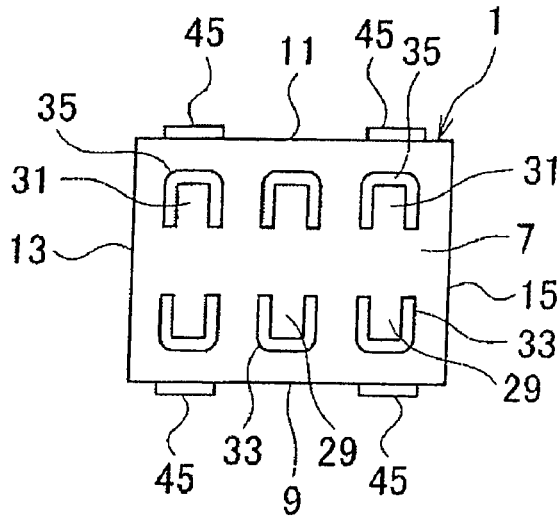
FIG. 5 is a plan view of the cover (the first embodiment)
Figure 6:
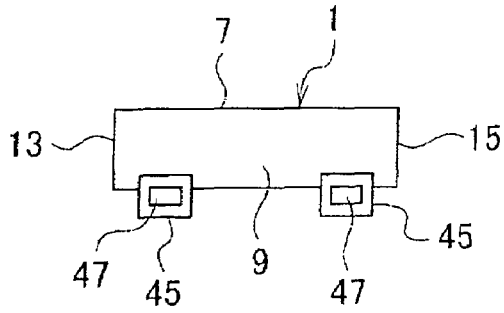
FIG. 6 is a plan view of the cover (the first embodiment)
Figure 7:
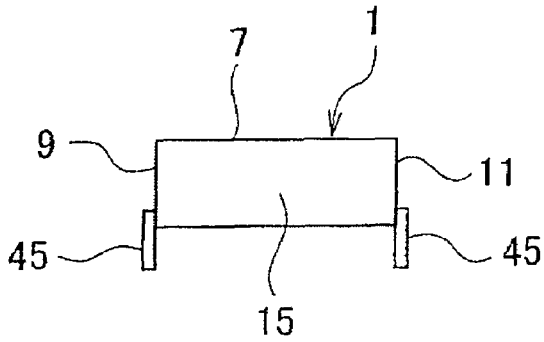
FIG. 7 is a side view of the cover (the first embodiment)
Figure 8:
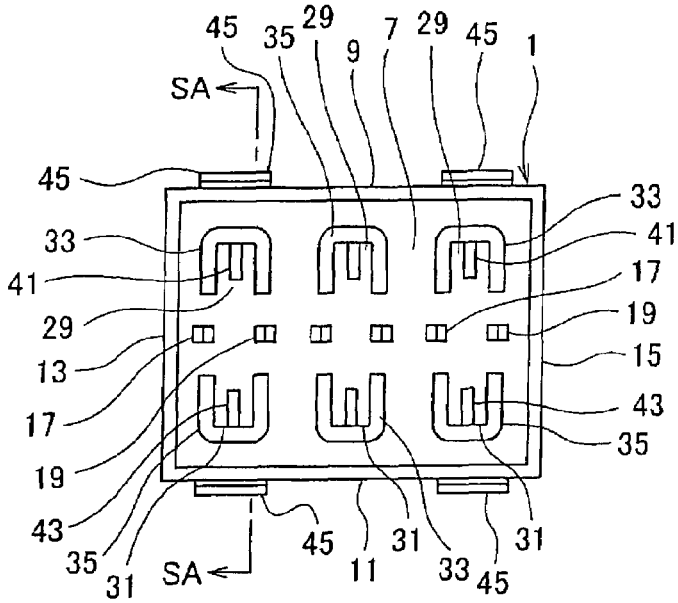
FIG. 8 is a view showing the back surface of the cover (the first embodiment)
Figure 9:
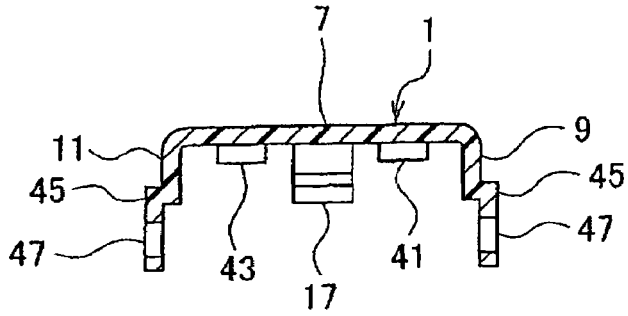
FIG. 9 is a sectional view taken along line SA-SA shown in FIG. 8.
Figure 10:
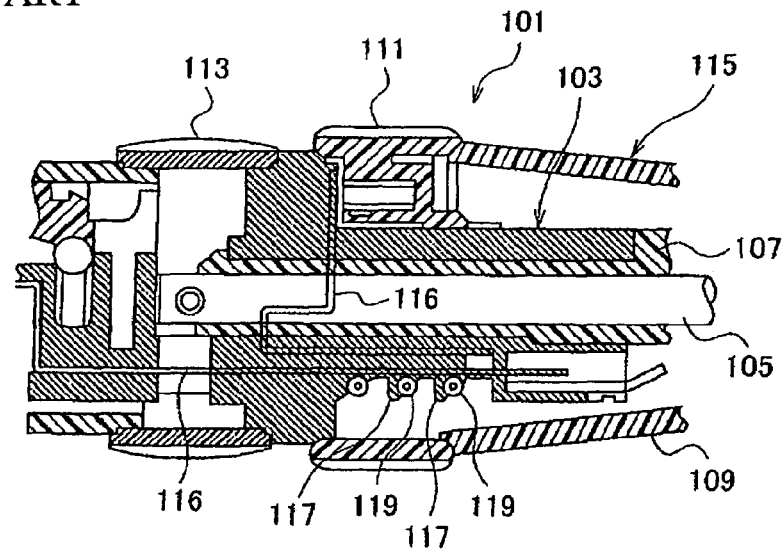
Fig.10 PRIOR ART
FIG. 10 is a sectional view showing a portion of a lever switch having a connection structure for resistive element (related art)
Figure 11:
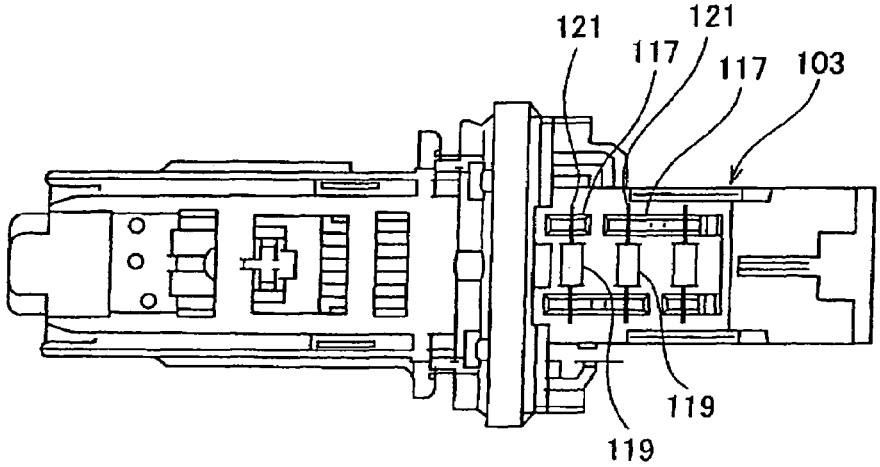
Fig.11 PRIOR ART
FIG. 11 is a plan view showing the base supplementarily.

FIGS. 1 to 9 show a first embodiment according to the present invention. FIG. 1 is a perspective view showing an essential portion where the cover is attached to the base. FIG. 2 is a side view showing the essential portion. FIG. 3(*a*) is a sectional view showing the essential portion. FIG. 3(*b*) is an enlarged view showing the connection between the connection section and the lead wire. FIG. 4 is a perspective view representing the state where the resistive element is attached to the cover. FIG. 5 is a plan view of the cover. FIG. 6 is a front view of the cover. FIG. 7 is a side view of the cover. FIG. 8 is a view showing the back surface of the cover. FIG. 9 is a sectional view taken along line SA-SA shown in FIG. 8.

Referring to FIGS. 1 to 4, resistive elements 3 are retained in the cover 1 which is detachably engaged to be fixed to a base 5 of an operation lever. The base 5 is provided for an operation lever of the lever switch device of the automobile and includes a terminal. The terminal is used as a relay to transmit the electric signal through operation of the slide switch functioning as the switch operation portion such that the cruise control unit is activated.

The cover 1 will be described referring to additional drawings of FIGS. 5 to 9. Referring to FIGS. 1 to 9, the cover 1 is entirely formed of plastics to have a rectangular box-like shape, including a top board 7 and side boards 9, 11, 13 and 15.

The top board 7 includes three pairs of fixing claws 17 and 19 as retaining portions at the center in the width direction (up-to-down direction in FIG. 5) in parallel, for example. The fixing claws 17 and 19 perform one-touch snap-holding of the resistive body 3 using elastic force. They are integrally formed on the top board 7 and have latch-like portions 21 and 23 at the respective top end portions. Opposite surfaces of the latch-like portions 21 and 23 have inclined guide surfaces 25 and 27, respectively.

The top board 7 includes elastic tongue portions 29, 31 as elastic portions adjacent to the fixing claws 17, 19, respectively. The elastic tongue portions 29, 31 are defined by U-like shaped slits 33 and 35 formed in the top board 7 of the cover 1 along lead wires 37, 39 of the resistive element 3 which has been snap fastened by the fixing claws 17, 19, respectively.

Protruding holding portions 41, 43 are formed integrally with the elastic tongue portions 29, 31, which are directed to the lead wires 37, 39. The protruding holding portions 41, 43 abut on the lead wires 37, 39, respectively in the state where the resistive element 3 is snap fastened between the fixing claws 17 and 19.

Hook portions 45 for engagement/fixation are disposed at two positions on each of the side boards 9 and 11. The hook portion 45 protrudes from the outer surface of each of the side boards 9 and 11 toward the base 5 and has an engagement window 47, respectively.

The base 5 has fixing protrusions 55 formed on both side walls 51, 53 at the respective sides of the resistive element attachment surface 49. A connection section 57 of the terminal is formed on the resistive element attachment surface 49. Three pairs of the connection sections 57 are provided, for example. Referring to FIG. 3(*b*), a connection grooves 59 of the connection section 57 has a wedge-like shape, and is elastically brought into tight fit to the lead wires 37, 39 which have been pressed thereagainst.

The resistive element 3 is preliminarily retained between the fixing claws 17 and 19 prior to the connection. The cover 1 is laid with the inner surface of the top board 7 up, and in this state, the resistive element 3 is pushed to be fit between the fixing claws 17 and 19. The resistive element 3 is thus pushed into abutment on the guide surfaces 25 and 27 of the fixing claws 17 and 19. The guide surfaces 25 and 27 receive the force from the resistive element 3. The resultant force bends the fixing claws 17 and 19 to open the space between the guide surfaces 25 and 27 such that the resistive element 3 is snap fastened between the fixing claws 17 and 19 through one touch as shown in FIG. 4. In the aforementioned snap fastened state, the latch-like portions 21 and 23 engage with the resistive element 3 so as to be fixed with the top board 7 between the latch-like portions 21 and 23.

When the resistive element 3 is retained between the fixing claws 17 and 19, the lead wires 37 and 39 at both ends of the resistive element 3 abut on the protruding holding portions 41 and 43, respectively so as to be slightly bent.

The thus attached resistive element 3 is retained between the fixing claws 17 and 19.

The cover 1 is then inverted to allow the resistive element 3 to face the resistive element attachment surface 49 of the base 5. The cover 1 is pushed against the resistive element attachment surface 49 such that each engagement window 47 of the respective hooks 45 is engaged with the corresponding fixing protrusion 55 at the base 5.

As the cover 1 is fixed to the base 5, the elastic tongue portions 29 and 31 of the cover 1 elastically abut on the connection section 57 via the lead wires 37 and 39. That is, the lead wires 37, 39 are fit to the connection groove 59 of the connection section 57 such that the protruding holding portions 41, 43 push the lead wires 37, 39 against the connection groove 59. The aforementioned pushing operation allows the reaction force to be received by the elastic tongue portions 29 and 31. The elastic tongue portions 29 and 31 are slightly bent to generate the elastic force. The resultant elastic force is applied to the lead wires 37, 39 via the protruding holding portions 41, 43. The lead wires 37, 39 are pushed against the connection groove 59, and are tightly fit with the connection groove 59 through its wedging function, thus making it sure to perform connection.

The process for staking and soldering to connect the lead wires 37, 39 of the resistive element 3 to the connection section 57 may be omitted to improve the assembly workability.

When the cover 1 is fixed to the base 5 in the state where the resistive element 3 is snap fastened between the fixing claws 17 and 19, the elastic tongue portions 29 and 31 receive the abutment force from the connection section 57 via the lead wires 37 and 39. The abutment force causes the elastic tongue portions 29, 31 to bend with respect to the cover 1, and to apply the elastic force to the lead wires 37, 39. The thus applied elastic force pushes the lead wires 37, 39 against the connection groove 59 of the connection section 57, making it sure to perform the connection. The wedging function of the connection groove 59 makes it sure to connect the lead wires 37, 39 to the connection section 57.

The base 5 is provided in the lever switch device for the automobile to improve the assembly workability.

The elastic portion is not limited to the one obtained by forming slits in the cover 1, but may be the one to be attached to the cover 1 as the separate member. The connection groove 59 of the connection section 57 is not limited to be formed as the wedge-like shape, but may be formed as the parallel groove.

The elastic tongue portions 29 and 31 are disposed opposite the connection section 57. However they may be arbitrarily formed so long as they push the lead wires 37, 39 against the connection groove 59 with the elastic force. The elastic tongue portions 29 and 31 may be positionally displaced with respect to the connection section 57.

The connection structure for resistive element is applicable to the device other than the lever switch device.

The invention claimed is:

1. A connection structure for a resistive element which connects a resistive element having a body and lead wires to a connection section of a terminal on a base, the connection structure comprising:

a cover fixable to the base to hold the resistive element between the cover and the base;

a retaining portion provided on an inner surface of the cover to retain the body of the resistive element; and an elastic portion provided on the inner surface of the cover along the lead wires of the resistive element; and the connection section provided on an inner surface of the base opposing the inner surface of the cover such that the elastic portion elastically pushes the lead wires against the connection section due to fixing of the cover to the base.

2. The connection structure for a resistive element according to claim 1, further comprising:

a protruding holding portion provided with the elastic portion, the protruding holding portion protruding toward the lead wire so as to abut on the lead wire;

a connection groove provided with the connection section, to fit the lead wire thereto, the protruding holding portion pushing the lead wire against the connection groove with the elastic force of the elastic portion.

3. The connection structure for a resistive element according to claim 1, wherein the base is disposed in a lever switch of an automobile to relay an operation signal of a switch operation unit of the lever switch device.

4. A connection structure for a resistive element which connects a resistive element with lead wires to a connection section of a terminal on a base, the connection structure comprising:

a cover fixable to the base;

a retaining portion provided with the cover, to retain the resistive element; and an elastic portion provided with the cover along the lead wires, the elastic portion elastically pushing the lead wires against the connection section upon fixing of the cover to the base, wherein:

the retaining portion is a fixing claw disposed adjacent to the elastic portion to snap fasten the resistive element with elastic force; and the elastic portion is provided by forming a slit in the cover.

5. Amended) The connection structure for a resistive element according to claim 4, further comprising:

a protruding holding portion provided with the elastic portion, the protruding holding portion protruding toward the lead wire so as to abut on the lead wire;

a connection groove provided with the connection section, to fit the lead wire thereto, the protruding holding portion pushing the lead wire against the connection groove with the elastic force of the elastic portion.

6. The connection structure for a resistive element according to claim 4, wherein the base is disposed in a lever switch of an automobile to relay an operation signal of a switch operation unit of the lever switch device.

* * * * *